US005337808A

United States Patent [19]

Graham

[11] Patent Number: 5,337,808

[45] Date of Patent: Aug. 16, 1994

[54] TECHNIQUE AND APPARATUS FOR SELECTIVE MULTI-ZONE VERTICAL AND/OR HORIZONTAL COMPLETIONS

[75] Inventor: Stephen A. Graham, Bellaire, Tex.

[73] Assignee: Natural Reserves Group, Inc., Houston, Tex.

[21] Appl. No.: 979,651

[22] Filed: Nov. 20, 1992

[51] Int. Cl.[5] ..... E21B 43/00

[52] U.S. Cl. ..... 166/191

[58] Field of Search ..... 166/191, 227–236, 166/242, 285, 312, 316, 373, 376

[56] References Cited

U.S. PATENT DOCUMENTS

| | | | |
|---|---|---|---|
| 3,329,205 | 7/1967 | Brown | 166/278 |
| 4,366,862 | 1/1983 | Brandell | 166/191 X |
| 4,416,331 | 11/1983 | Lilly | 166/236 |
| 4,436,165 | 3/1984 | Emery | 166/285 X |
| 4,606,408 | 8/1986 | Zunkel et al. | 166/191 X |
| 4,877,086 | 10/1989 | Zunkel | 166/191 X |

*Primary Examiner*—Thuy M. Bui

*Attorney, Agent, or Firm*—G. Turner Moller

[57] ABSTRACT

A vertical cased well penetrates two or more hydrocarbon bearing formations. A deviated well includes a horizontal drain hole extending a substantial distance into at least one of the formations. A production string is cemented in the horizontal drain hole and is cut off inside the vertical cased well. Perforations through the vertical cased well communicate the well with some or all of the formations. A production assembly in the vertical cased well includes a series of external casing packers isolating the hydrocarbon bearing formations. Wire wrapped port collars between the external casing packers controls flow into the production assembly and upwardly through the well. A resin coated sand may be plated in the annulus between the production assembly and the vertical casing to control the production of formation solids. The external casing packers straddling the entry of the horizontal drain hole into the vertical well may be provided with a bypass to allow the resin coated sand to overflow into the annulus above the production assembly.

19 Claims, 4 Drawing Sheets

TECHNIQUE AND APPARATUS FOR SELECTIVE MULTI-ZONE VERTICAL AND/OR HORIZONTAL COMPLETIONS

This invention relates to a method and apparatus for simultaneously completing multiple hydrocarbon productive zones and/or horizontal drain holes to facilitate selective testing, stimulation, and/or production through isolated horizontal and vertical completions in a single well. The resulting well permits a downhole pump to be installed in the cased vertical portion of the well at a location below all producing horizons and/or horizontal drain holes.

It is not uncommon for a vertical well to encounter a plurality of hydrocarbon productive formations with varying degrees of potential productivity. Due to differences in reservoir pressure, fluid content and petrophysical properties, downhole commingling of production from multiple zones is often not only detrimental to the ultimate recovery of the well, but prohibited by government regulatory agencies.

A number of different completion methods have been used to independently produce multiple zones encountered in a single well. In the simplest of these completion techniques, the lowermost productive zone is perforated and produced until the hydrocarbon production rate becomes economically marginal. Then, the zone is abandoned and the well is recompleted to the next shallower zone. Upon depletion of this zone, the well is again recompleted and produced until all potential zones have been produced. Upon depletion of the shallowest productive zone, the well is plugged and abandoned. A graph showing hydrocarbon production rate versus time for such a well would typically exhibit a "roller coaster" profile with relatively high production rates occurring immediately after each new zone completion.

In an effort to prolong a well's flush production period and smooth out this "roller coaster" production profile, more complex completion methods are employed. One such technique involves using multiple strings of production tubing with specially spaced multiple completion packers for isolating each completed zone. An important drawback to this type completion design is the size of independent production strings make it difficult to artificially lift the produced fluids from each zone should the well cease to flow naturally.

Multi-zone techniques facilitating the independent completion of one or more horizontal drain holes extending from a vertical well together with one or more "conventional" vertical well completions, i.e. perforations in the casing adjacent the productive zone, are not known in the prior art.

Horizontally drilled wells, or wells which have nearly horizontal sections, have recently become quite popular in attempting to make commercial wells in vertically fractured formations, such as the Austin Chalk or Bakken Shale. Horizontally drilled wells also have many advantages in sandstone or limestone/dolomite reservoirs having matrix porosity. Horizontal wells produce a great deal more because more of the formation is exposed to the well bore. In addition, the "linear flow" characteristics produce much smaller pressure drops near the well bore. These smaller pressure drops leads to lower flow velocities near the well bore and less water, gas and/or-steam coning tendencies when compared to the "radial flow" characteristics inherent in vertical wells.

The majority of horizontal wells are rather simply completed in the sense that one or more horizontal drain holes commingle well fluids in a vertical part of the well with conventional vertical well completions located above the uppermost drain hole. The commingled fluids either flow or are artificially lifted from the vertical part of the well by equipment located substantially above the uppermost drain hole. A major shortcoming of most types of multi-zone completion techniques is they do not afford independent testing, stimulation and/or production of each completed zone or drain hole. In addition, the resulting well precludes a downhole pump from being installed below all productive horizons to optimize pressure drawdown during production operations and increase artificial lift efficiency. Finally, differences in reservoir pressure and incompatibilities in the fluid and petrophysical characteristics of each completed formation may not warrant downhole commingling. It is to this end that the present invention has been developed although other applications are readily apparent.

It is known in the prior art to place a series of external casing packers on a production string extending into a horizontal well bore as shown in a catalogue of TAM International. Port collars are a well known component available from TAM International. Of some interest relative to various aspects of this invention are the disclosures in U.S. Pat. Nos. 7,479; 3,115,187 and 3,901,318.

As shown in applicant's copending application Ser. No. 07/943,448, filed Sep. 10, 1992, and entitled COMPLETING HORIZONTAL DRAIN HOLES FROM A VERTICAL WELL, the specification of which is incorporated herein by reference, a horizontal drain hole is drilled a substantial distance from a vertical well into a hydrocarbon bearing formation. A production string is run into the well so it extends from adjacent the horizontal well bore, through the curved well bore section and into the vertical cased hole or vertical open hole. The well is cemented so at least the curved portion of the well bore includes an impermeable sheath around the production string isolating the horizontal target pay zone and production string from overlying formations. After the cement cures, that portion of the production string extending into the vertical cased hole or vertical open hole is cut off by the use of a conventional full gauge burning shoe/wash pipe assembly, leaving a relatively clean intersection between the curved and vertical well bore sections. Another horizontal well bore section may be drilled and completed off the vertical hole into the same or a different hydrocarbon bearing formation. In addition, it will be seen that one or all of the hydrocarbon bearing formations may also be perforated or otherwise completed directly from the vertical well to provide both vertical and horizontal completions producing into the same vertical cased well.

In this invention, a production liner assembly is run on a work string to a location in the vertical part of the well adjacent to the horizontal productive zones and points of entry of the horizontal drain holes with the vertical well. The liner is designed to isolate production from a plurality of producing formations, one or more of which are penetrated by at least one horizontal drain hole. Selective manipulation of the production liner assembly allows one or more of the vertical well completions and/or drain holes to be produced while others are left shut in. Vertically completed zones and/or drain hole completions may be opened and closed off to production repeatedly throughout the life of the well in relatively inexpensive workover operations.

The production liner assembly includes a central conduit incorporating a plurality of mechanically actuated port collars straddled by inflatable external casing packers. The packers, when expanded, isolate the port collars from each other. When the assembly is run into the vertical part of the well, it is positioned so the external casing packers isolate each of the producing zones and/or each of the entries of the horizontal drain holes into the vertical well from adjacent zones and/or drain holes. The port collars are selectively opened to allow one or more of the formations and/or horizontal drain holes to produce into the vertical well. Similarly, one or more of the port collars may be closed to shut off specific intervals and/or drain holes.

Many of the situations where it is desirable to use this invention involve sandstone or other reservoir rocks that are prone to produce formation solids. In these situations, a solids filter device, such as a wire wrapped screen, is provided around the port collars to provide sand control to prevent sand or other formation solids from entering the production liner assembly. In addition, a quantity of gravel pack material such as a curable resin coated sand is placed in the annulus between the casing string or open hole and the production liner assembly to retard the movement of formation solids.

To this end, the external casing packers adjacent the entry of the horizontal well bore into the vertical well are first expanded. A gelled slurry containing a curable resin-coated sand is pumped through the work string and through the production liner assembly to exit into the annulus between the production assembly and the casing of the vertical well. The resin-coated sand slurry flows through bypasses in the packers and then upwardly into the annulus between the work string and the casing of the vertical well. Means are provided to allow the slurry to bypass the entry of the drain hole. After placement of the resin coated sand slurry, a wiper plug is landed in a profile landing seat located in the bottom of the production liner assembly and the remaining hydraulic packers are inflated to isolate the "conventional" vertical well completions.

In accordance with one aspect of the invention, a hydrocarbon producing well comprises a vertical cased well penetrating upper and lower hydrocarbon bearing formations, a deviated well bore opening into the vertical well and having a generally horizontal well bore section extending into the upper formation, means establishing communication between the vertical cased well and the lower formation, a production string extending upwardly in the vertical well, and a production liner assembly comprising a conduit having an upper end, upper and lower external packers straddling the deviated well bore and isolating the deviated well bore from the lower formation, a first openable flow control device between the packers selectively allowing and preventing flow from the deviated well bore into the conduit and a second openable flow control device below the lower packer selectively allowing and preventing flow from the lower formation into the conduit.

It is an object of this invention to provide an improved method for making multiple completions incorporating horizontal drain holes.

Another object of this invention is to provide an apparatus for sand control having openable port collars encased in sand control filters.

Still another object of this invention is to provide an improved method and apparatus for making multiple completions incorporating flow control means encased in sand control filters straddled by hydraulically activated packers for interval isolation.

A further object of this invention is to provide an improved method and apparatus for completing multiple horizontal well bores incorporating an external casing packer having a bypass therethrough.

These and other objects of this invention will become more fully apparent as this description proceeds, reference being made to the accompanying drawings and appended claims.

Figure 1:
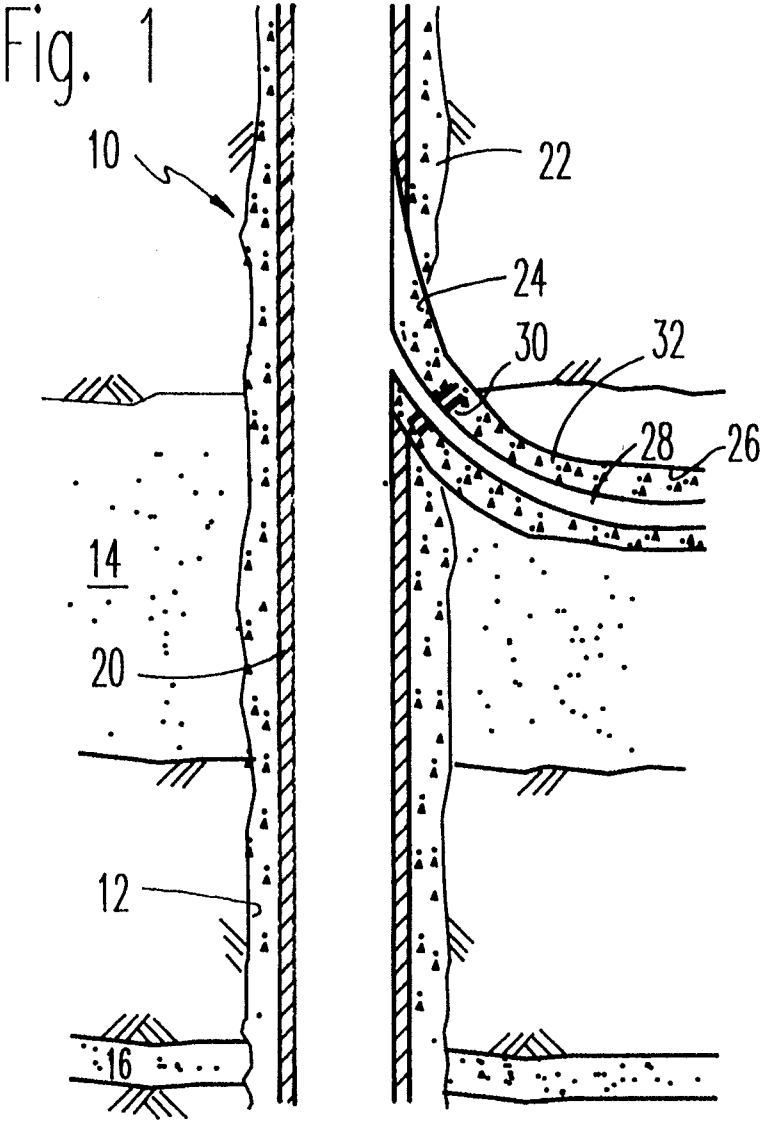
FIG. 1 is a cross-sectional view of a well in an intermediate stage of completion.

Referring to FIG. 1, a well 10 includes a bore hole 12 drilled into the earth to penetrate a plurality of hydrocarbon bearing formations 14, 16. A casing string 20 is cemented in the bore hole 12 by a cement sheath 22 to isolate the hydrocarbon bearing formations 14, 16 from each other and from other permeable formations. Preferably, the casing string 20 is of relatively large size, e.g. 7" or larger. As explained in applicant's copending application Ser. No. 07/943,448, filed Sep. 10, 1992, entitled COMPLETING HORIZONTAL DRAIN HOLES FROM A VERTICAL WELL, a deviated well bore 24 has been drilled into the formation 14 and includes a generally horizontal section 26. A production string 28 having centralizers 30 thereon is run into the deviated well bore 24 and cemented in place to provide a cement sheath 32 isolating the well bore 24 from any overlying water bearing formations and preventing gas or steam coning along the upper boundary of the formation 14.

The upper end of the production string 28 and some cement initially extends into the vertical portion of the well 10. This portion of the production string 28 and cement is cut off, using a burning shoe/wash pipe assembly, to leave a relatively clean entry opening of the deviated well bore 24 into the vertical portion of the well 10. It will accordingly be seen that FIG. 1 illustrates the well 10 at a time slightly after FIG. 5 in applicant's copending application.

It will be evident that the deviated well bore 24 may be directed into the lower formation 16, rather than the upper formation 14, depending on which is the best candidate for a horizontal completion. Indeed, a deviated well bore may be drilled into more than one of the formations 14, 16, as explained in applicant's copending application.

Figure 2:
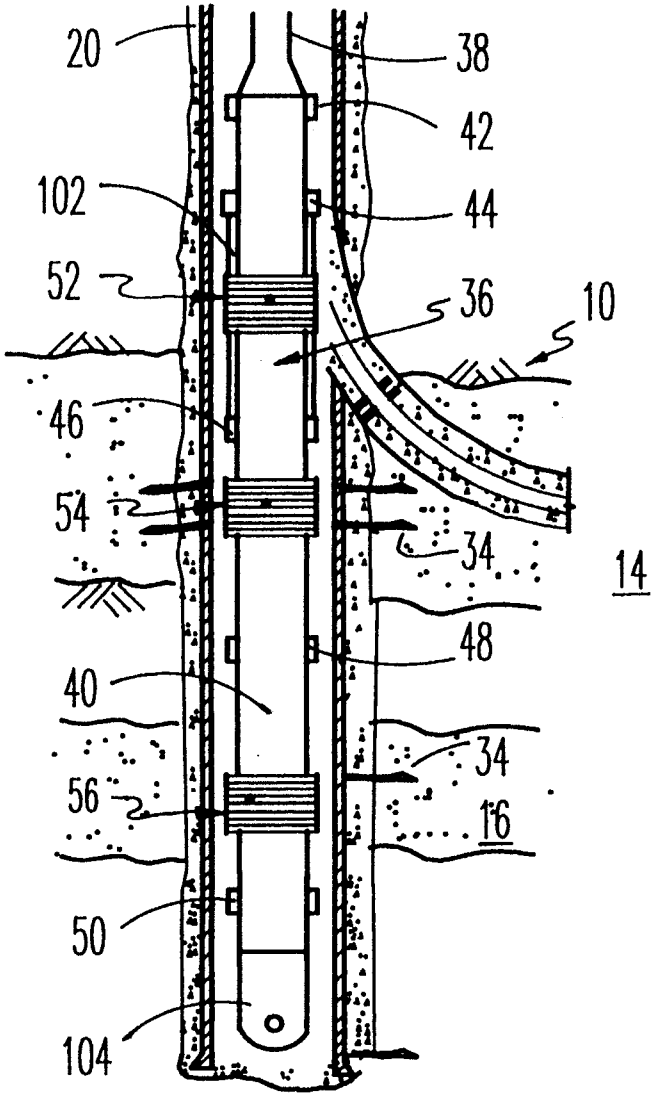
FIG. 2 is a cross-sectional view of the well of FIG. 1 at a later stage of completion.

Referring to FIG. 2, the formation 14 and the other productive formation 16 are perforated thereby providing flow passages 34 communicating between the hydrocarbon bearing formations and the interior of the casing 20. A production liner assembly 36 is run into the well 10 on the bottom of a work string 38 and is manipulated to isolate horizontal and vertical completions in the formation 14 and to isolate the formation 16 and to selectively produce from one or more of the formations.

To this end, the production liner assembly 36 comprises a conduit 40 having a liner hanger/packer 42 on the upper end thereof to support and packoff the production liner assembly 36 from the casing string 20. Preferably, the conduit 40 is casing sized, i.e. at least 4 ½ OD and preferably 5" OD for purposes more fully apparent hereinafter. The production liner assembly 36 also comprises a plurality of hydraulically activated packers 44, 46, 48, 50 isolating the formations 14, 16 and a plurality of mechanically activated flow control devices 52, 54, 56 as explained more fully hereinafter.

The hydraulically activated packers 48, 50 are preferably identical, are of conventional design, are preferably of the inflatable external casing packer type and are available from a variety of manufacturers, such as Baker Service Tools or TAM International. Although the packers 44, 46 may be identical to the packers 48, 50 and act in a conventional manner, there are some situations where it is desired to provide one or more bypasses 58 as suggested in FIG. 2 and shown more clearly in FIG. 3.

Figure 3:
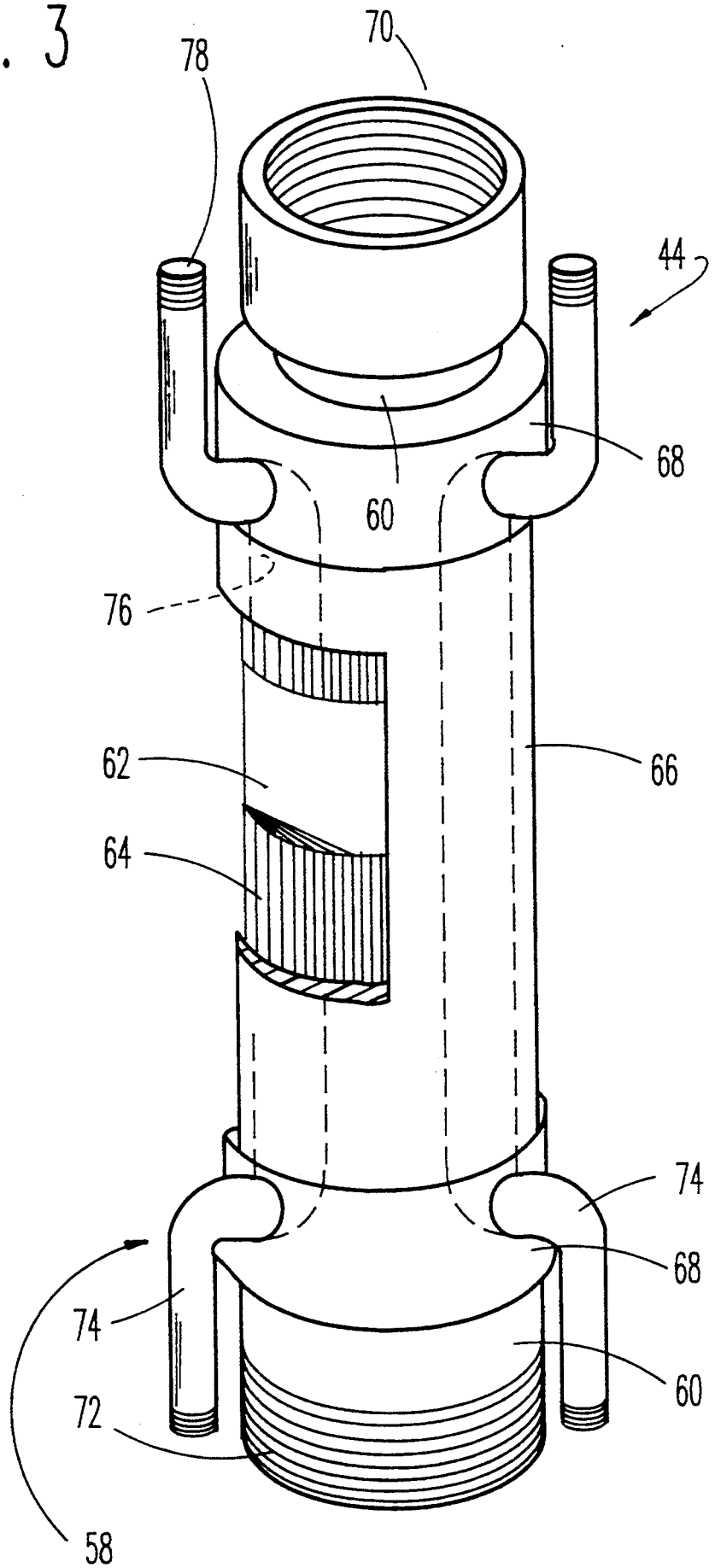
FIG. 3 is a partial cross-sectional view of a modified external casing packer of this invention.

As shown in FIG. 3, the hydraulically activated packer 44 includes a mandrel 60 which is usually a casing pup joint, an inflatable member 62, a flexible metal reinforcing member 64 extending axially along the length of the inflatable member 62, a thick exterior rubber sheath 66 and an internal system of passages, shear pins and check valves (not shown) for inflating the member 62 and forcing the rubber sheath 66 against the interior of the casing 20 or open bore hole wall (not shown). One or more sleeves 68 surround the mandrel 60 and restrain axial movement of the inflatable member 62, the flexible reinforcing member 64 and the rubber sheath 66. A collar 70 is provided at one end of the packer 44 and a pin 72 is provided at the other. Those skilled in the art will recognize the packer 44 as representative of an inflatable external casing packer, such as made by TAM International or Baker Service Tools.

One or more lower bypass conduits 74 are connected to the exterior of the lower end of the mandrel 60 and communicate through the lower sleeve 68 with a pair of conduits 76 underneath the inflatable member 62. At the upper end of the inflatable member, the conduits 76 connect through the upper sleeve 68 to a pair of conduits 78. It will accordingly be seen that the bypass 58 comprises the conduits 74, 76, 78.

Figure 4:
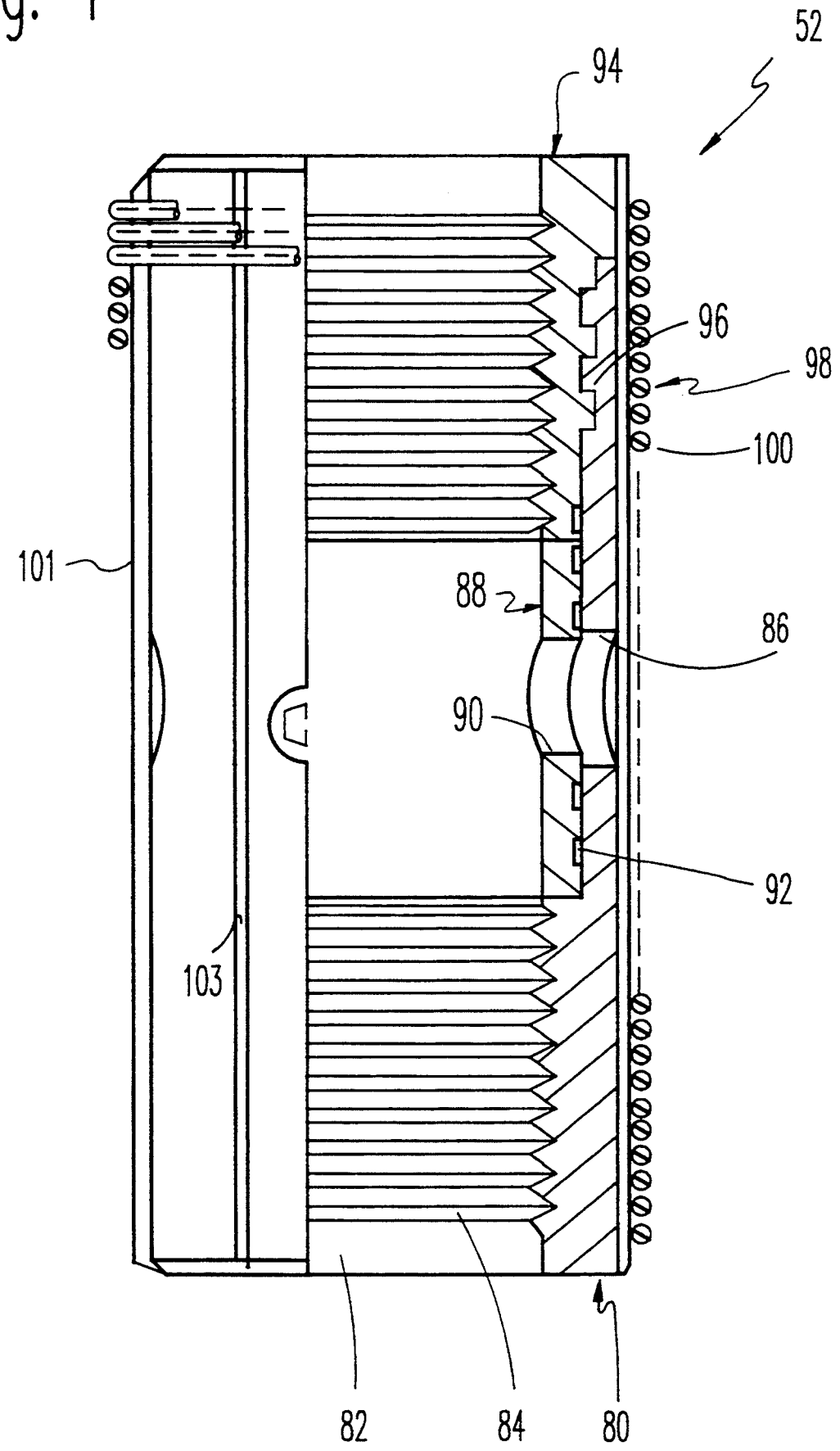
FIG. 4 is a partial cross-sectional view of a modified port collar of the invention.

The flow control devices 52, 54, 56 are conveniently identical. Referring to FIG. 4, the flow control device 52 is illustrated as a conventional port collar having a body 80 providing an axial passage 82, lower threads 84 and one or more transverse passages or ports 86. A sliding sleeve 88 provides one or more ports 90 and a plurality of O-ring seals 92 sealing against the body 80. An upper collar 94 provides threads 96 and acts to captivate the sleeve 88 in place. Those skilled in the art will recognize the flow control device 52, as heretofore described, as a port collar made by TAM International.

A solids filtration sleeve 98 is attached to the exterior of the port collar 52 and may comprise a conventional sand control screen such as a wire 100 wrapped around a plurality of axially extending ribs 101 welded onto the exterior of the body 80. Some of the ribs 101 extend across the port openings 86 and additional ribs 101 provide passages 103 therethrough to allow produced fluids to reach the port openings 86. The wire 100 extends across the aligned ports 86, 90 and the adjacent wraps thereof are sufficiently close together to prevent entry of formation solids above a predetermined size into the interior of the port collar 52 through the aligned ports 86, 90. The axial ribs welded to the exterior of the body 80 serve to secure the wire 100 to the port collar 52 and to provide standoff clearance between the wire 100 and the body 80. To reduce the possibility of screen plugging, the length of the wire wrapped area may be increased to provide more filter surface area. To this end, a ribbed sub (not shown) is threaded into one or both ends of the port collar 52 to provide additional length around which the wire 100 may be wound. The subs include a sufficient non-wire wound section to receive a wrench or tong to thread the port collar 52 into the production liner assembly. Both ends of the solids filtration sleeve 98 are welded closed and secured onto the ends of the body 80 or to the ribbed subs (not shown) as desired.

Placement of the production assembly 36 should now be apparent. The production liner assembly 36 is assembled with high pressure hoses or conduit 102 connecting the upper bypass conduits 78 of the packer 46 to the lower bypass conduits 74 of the packer 44 and a hydraulically operated stage tool 104 at the bottom of the assembly 36. The packers 44, 46 are designed to inflate at a first pressure and the packers 48, 50 are designed to inflate at a second pressure higher than the first pressure. The production liner assembly 36 is attached to the bottom of the work string 38 and run into the hole completely dry to allow the external casing packers 44, 46 to be inflated with nitrogen.

Figure 5:
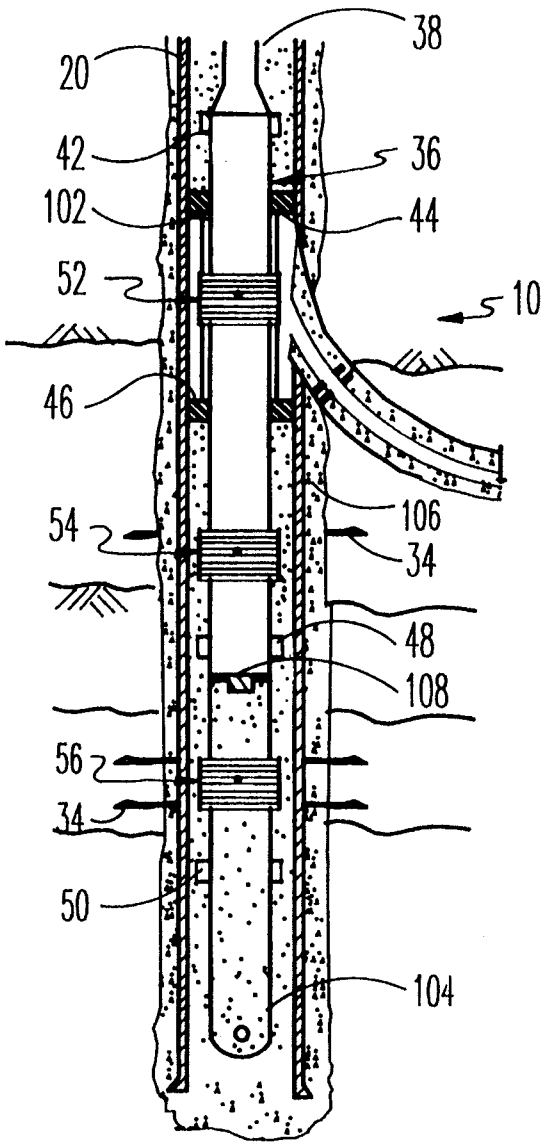

As shown in FIG. 5, the packers 44, 46 are first inflated by pressuring up the work string 38 and production liner assembly 36 with nitrogen to the first inflation pressure, e.g. 3000 psi. The packers 44, 46 are of the type that stay inflated despite a drop in pressure in the assembly 36 below the inflation pressure. With the flow control devices 52, 54, 56 closed, the work string 38 and assembly 36 are filled with water and the stage tool 104 is opened. This may be accomplished by pressuring up on the work string 38 after dropping a free ball bomb 108 through the work string 38 and assembly 36. A quantity of high density curable resin coated sand slurry 106 is pumped down the work string 38 and down the production assembly 36 to exit through the stage tool 104. The resin coated sand 106 flows upwardly in the annulus between the casing 20 and the production assembly 36. It is desired that an excess of resin coated sand 106 be pumped into the production liner assembly 36 to ensure that the annulus and the perforations 34 are as full as they can be. Thus, excess resin coated sand 106 passes upwardly through the packer bypasses 58 and bypass conduits 102 and around the packers 44, 46 into the annulus between the casing 20 and the work string 38.

Figure 6:
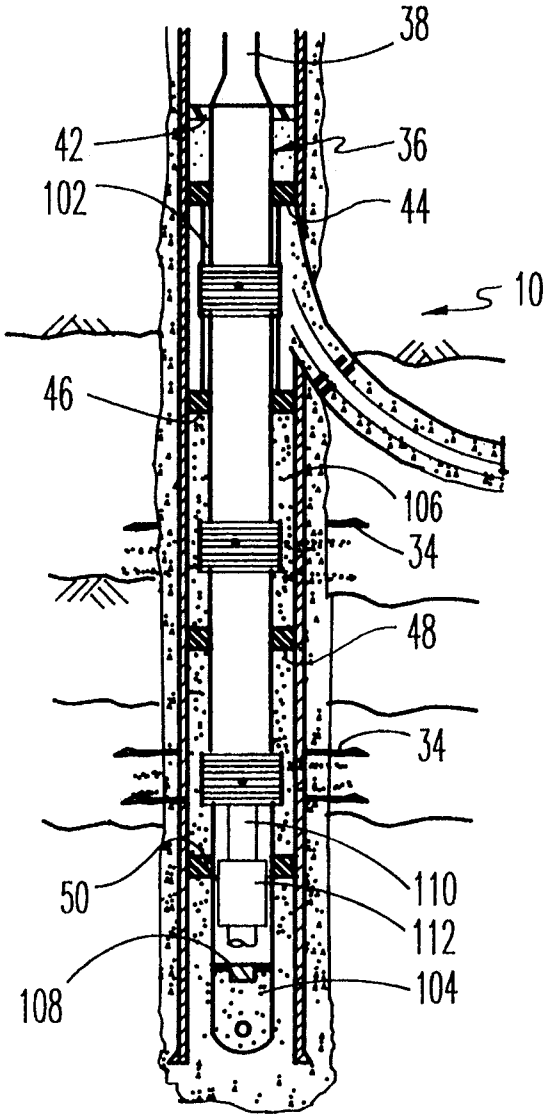
FIGS. 5–6 are cross-sectional views of the well of FIGS. 1 and 2 at later stages of completion.

The resin coated sand 106 is followed down the work string 38 and down the production liner assembly 36 by one or more wiper plugs 108 chased by high pressure nitrogen. When the wiper plug 108 lands in the stage tool 104, the interior of the production assembly 36 is again sealed. The packers 48, 50 are then expanded by increasing the pressure in the production liner assembly 36 to the second inflation pressure, e.g. 5000 psi. The liner hanger/packer 42 is then set as shown in FIG. 6. The work string 38 is detached from the liner hanger/-packer 42 and any excess resin coated sand 106 above the liner hanger 42 is circulated out of the hole and the work string 38 is pulled out of the hole. If desired, the stage tool 104 may be drilled up, as by placing a bit on the bottom of a work string, running the bit into the hole and drilling up the stage tool 104.

A tool (not shown) to manipulate the flow control devices 52, 54, 56 is then run into the well to test, stimulate and/or produce the different completions. The tool may be run on either production tubing, coiled tubing, electric wireline or non-electric wire line, depending on the type of flow control devices installed. The formations 14, 16 may be produced separately or commingled as conditions dictate. For example, one or two tubing strings can be run into the well and sealed against the conduit 40 with a packer (not shown) at a point below the formation 14 and above the formation 16 to provide separate flow paths for the production from each of the formations 14, 16. In the alternative and as shown in FIG. 6, a single production string 110 may extend into the production assembly 36 and provide a pump 112 in the cased sump located below all producing horizons If the stage tool 104 is drilled up, only the pump 112 may extend into the large diameter cased sump located below the production assembly 36. Thus, only one of the formations 14, 16 may be produced by leaving only one or two of the port collars open or all of the completions can be produced by opening all of the port collars. By relatively inexpensive workover operations, port collars may be selectively opened and closed at any time during the life of the well 10.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A hydrocarbon producing well comprising a vertical well penetrating first and second hydrocarbon bearing formations;

a deviated well bore entering into the vertical well through an opening and having a generally horizontal well bore section extending into a first of the formations;

means establishing communication between the vertical well and a second of the formations; and a production liner assembly in the vertical well comprising a conduit having an upper end, upper and lower external packers straddling the opening and isolating the upper formation, a first openable flow control device between the packers selectively allowing and preventing flow from the upper formation into the conduit and a second openable flow control device below the lower packer selectively allowing and preventing flow from the lower formation into the conduit.

2. The well of claim 1 wherein the vertical well bore is cased and the deviated well bore adjacent the vertical well is cased.

3. The well of claim 1 wherein the openable flow control devices comprise a conduit section having an internal axial flow passage and at least one transverse flow passage connecting the internal flow passage to the exterior of the conduit section, means selectively closing the transverse flow passage and a screen on the exterior of the conduit section preventing formation particles larger than a predetermined size from entering the transverse flow passage.

4. The well of claim 3 wherein the screen comprises a wire helically wrapped about the conduit section.

5. The well of claim 1 further comprising a vertical production string extending into the production liner assembly and having a pump thereon.

6. The well of claim 1 wherein the external packers straddling the deviated well bore opening provide a bypass extending from below the external packer below the deviated well bore opening through the external packer above the deviated well bore entry and further comprising a permeable sand control material in an annulus between the casing and the production liner assembly, permeable sand control material extending upwardly through the bypass.

7. A hydrocarbon producing well comprising a vertical well penetrating a hydrocarbon bearing formation;

means providing a first completion and establishing communication between the vertical well and the formation including a deviated well bore entering into the vertical well through an opening and having a deviated section extending into the formation;

means providing a second completion and establishing communication between the vertical well and the formation; and a production liner assembly in the vertical well comprising a conduit having an open upper end, first casing packers straddling the deviated well bore opening and isolating the first completion from the second completion, second casing packers straddling the second completion and isolating the second completion from the first completion, a first openable flow control device between the first packers selectively allowing and preventing flow from the first completion into the conduit and a second openable flow control device between the second packers selectively allowing and preventing flow from the second completion into the conduit.

8. A production liner assembly for running into a well comprising a conduit having an upper end, spaced upper and lower expandable external packers for straddling and isolating a first production opening, a bypass from below the lower expanded packer to above the upper expanded packer, a first openable flow control device between the packers selectively allowing and preventing flow from the first production opening into the conduit, and a second openable flow control device below the lower packer selectively allowing and preventing flow from a second production opening into the conduit.

9. The assembly of claim 8 wherein the openable flow control devices comprise a conduit section having an internal axial flow passage and at least one transverse flow passage connecting the internal flow passage to the exterior of the conduit section, means selectively closing the transverse flow passage and a screen on the exterior of the conduit section preventing formation particles larger than a predetermined size from entering the transverse flow passage.

10. The assembly of claim 9 wherein the screen comprises a wire helically wrapped about the conduit section.

11. An openable flow control apparatus for use in a subterranean well having a production zone and containing fluid in the well, comprising a conduit section having an internal axial flow passage and at least one transverse flow passage providing a radial passageway from the exterior of the conduit section, exposed to the production zone, to the internal axial flow passage, means selectively closing the transverse flow passage including a member blocking the radial passageway, and a screen, attached to and carried by the conduit section, on the exterior of the conduit section preventing particles larger than a predetermined size from entering the transverse flow passage.

12. The flow control apparatus of claim 11 wherein the screen comprises a wire helically wrapped about the conduit section.

13. The flow control apparatus of claim 11 further comprising a plurality of ribs extending axially along the exterior of the conduit section, the screen being wrapped around the ribs.

14. The flow control apparatus of claim 13 wherein at least some of the ribs extend across the transverse flow passage.

15. The process of completing a well comprising the steps of providing a vertical well penetrating a hydrocarbon bearing formation, drilling a deviated well bore away from the vertical well through an opening therein and providing a more-or-less horizontal well bore section extending into the hydrocarbon bearing formation, running a production liner assembly into the vertical well including a conduit having a pair of packers straddling the opening and at least one flow control device between the packers, sealing the packers against the cased well, and pumping a permeable sand control material downwardly through the production liner assembly, upwardly around the production liner assembly and upwardly through a bypass around the packers into the vertical well above the packers.

16. The process of claim 15 further comprising the step of placing at least one additional packer on the conduit, leaving the additional packer away from the conduit while the permeable sand control material is pumped around the additional packer and then sealing the additional packer against the vertical well.

17. The process of completing a well comprising the steps of providing a vertical well penetrating at least one hydrocarbon bearing formation, establishing a first completion and providing communication between the vertical well and the formation by drilling a deviated well bore away from the vertical well through an opening and providing a well bore extending into the formation, establishing a second completion between the vertical well and the formation, running into the vertical a production liner assembly including a conduit having a pair of first casing packers straddling the deviated well bore opening and at least one openable flow control device between the packers, a pair of second casing packers straddling the second completion and at least one openable flow control device between the packers, and sealing the packers against the vertical well.

18. An openable flow control apparatus for use in a subterranean well having a production zone and containing fluid in the well, comprising a conduit section having an internal axial flow passage, at least one transverse flow passage to the exterior of the conduit section, and a plurality of ribs extending axially along the exterior of the conduit section, means selectively closing the transverse flow passage, and a screen on the exterior of the conduit section, wrapped around the ribs, preventing particles larger than a predetermined size from entering the transverse flow passage.

19. The flow control apparatus of claim 18 wherein at least some of the ribs extend across the transverse flow passage.

* * * * *